US007481551B2

(12) United States Patent
Sharrah

(10) Patent No.: US 7,481,551 B2
(45) **Date of Patent: *Jan. 27, 2009**

(54) FLASHLIGHT HAVING BACK LIGHT ELEMENTS

(75) Inventor: Raymond L. Sharrah, Collegeville, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/423,644

(22) Filed: Jun. 12, 2006

(65) Prior Publication Data

US 2006/0262527 A1 Nov. 23, 2006

Related U.S. Application Data

(63) Continuation-in-part of application No. 10/703,993, filed on Nov. 7, 2003, now Pat. No. 7,059,744.

(51) Int. Cl.
*F21L 4/02* (2006.01)

(52) U.S. Cl. ..... 362/208; 362/184; 362/185; 362/186

(58) Field of Classification Search ..... 362/184–186, 362/202, 205, 208, 228, 102
See application file for complete search history.

(56) References Cited

U.S. PATENT DOCUMENTS 1,203,576 A 11/1916 Broadhead
1,645,487 A 10/1927 Harling
1,671,744 A 5/1928 Rosenberg
1,816,065 A 7/1931 Weidman
2,716,700 A 8/1955 La France
3,003,057 A 10/1961 Cheng
4,045,663 A * 8/1977 Young ..... 362/253
4,135,230 A 1/1979 Armbruster
5,067,058 A 11/1991 Standley
D353,055 S 12/1994 Kish et al.
5,755,644 A 5/1998 Breems
5,800,045 A 9/1998 Kish et al.
5,871,272 A 2/1999 Sharrah et al.
6,099,141 A * 8/2000 Landamia ..... 362/184
6,158,874 A * 12/2000 Brustein et al. ..... 362/184
6,168,288 B1 1/2001 St. Claire
6,302,570 B1 * 10/2001 Petell et al. ..... 362/554
6,305,818 B1 10/2001 Lebens et al.
6,318,879 B1 * 11/2001 Huang ..... 362/205
6,331,062 B1 12/2001 Sinclair (Continued)

OTHER PUBLICATIONS

Webster's II New College Dictionary, published 1995, Houghton Mifflin Co. p. 559.

(Continued)

*Primary Examiner*—Jong-Suk (James) Lee
*Assistant Examiner*—Robert May
(74) *Attorney, Agent, or Firm*—Stephen H. Eland; Dann, Dorfman, Herrell and Skillman

(57) ABSTRACT

A battery powered flashlight is provided having a primary lamp assembly providing a high powered light source in a forward direction, and a back light providing a lower powered light source in a rearward facing direction. Preferably, the flashlight includes a hollow housing having a back wall into which one or more apertures are formed for receiving one or more back light elements.

16 Claims, 9 Drawing Sheets

U.S. PATENT DOCUMENTS

| | | | | |
|---|---|---|---|---|
| 6,439,733 | B1 | 8/2002 | Fischer et al. | |
| 6,450,659 | B1 | 9/2002 | Salatino | |
| 6,523,972 | B2 | 2/2003 | Sharrah et al. | |
| 6,565,241 | B1 | 5/2003 | Glynn | |
| RE40,342 | E * | 5/2008 | Krieger | 362/184 |
| 2002/0149928 | A1 | 10/2002 | Watterson et al. | |
| 2002/0191396 | A1 | 12/2002 | Reiff et al. | |
| 2003/0156407 | A1 | 8/2003 | Galli | |

OTHER PUBLICATIONS

The "10 Mile Light", Bright Star Product Brochure published before Nov. 7, 2003, 2 pages.
LiteBox, sold prior to Nov. 2003.

* cited by examiner

FLASHLIGHT HAVING BACK LIGHT ELEMENTS

PRIORITY

This application is a continuation-in-part of U.S. patent application Ser. No. 10/703,993, filed Nov. 7, 2003, which is set to issue on Jun. 13, 2006 as U.S. Pat. No. 7,059,744, which is hereby incorporated by reference.

FIELD OF THE INVENTION

The present invention relates to portable lights, such as battery-powered flashlights. More specifically, the present invention relates to a flashlight having a primary light source providing forward facing light and a secondary light source providing rearward facing light.

BACKGROUND

Flashlights are used in a variety of fields and a variety of applications. In certain applications, such as, low light, obstructed view light applications, it is difficult to see the operator from behind, since the beam of light from the flashlight is shining forwardly. For instance, in emergency applications, such as in firefighting applications, emergency personnel using a flashlight shining forwardly may not be easily seen due to difficulties or obstructions arising from the fire and smoke. In such applications, it is important to be able to quickly locate and identify the emergency personnel. Furthermore, flashlights used in emergency applications should be configured to withstand adverse conditions and significant abuse that arises when responding to emergency situations.

SUMMARY OF THE INVENTION

In light of the foregoing, the present invention provides a flashlight having a primary lamp facing forwardly to provide a primary light source. In addition, the flashlight provides a back light directed rearwardly, so that the back light allows the flashlight to be easily identified from behind, thereby making it easier to identify an emergency personnel using the flashlight in an emergency situation. In addition, the back light is designed to withstand the harsh environment and abuse that is common in emergency situations.

More specifically, the present invention provides a flashlight having a housing and a lamp assembly connected with the forward end of the housing to provide a light source directed forwardly. The flashlight further comprises a back light at the rearward end of the housing to provide a light source directed rearwardly. Preferably, the back light comprises an LED. In addition, preferably, the housing includes an aperture for receiving the back light thereby reducing the portion of the back light that projects rearwardly from the housing. By doing so, the back light is protected so that is less likely to be damaged during use. The flashlight further includes a switch for controlling the operation of the lamp assembly and the back light.

DESCRIPTION OF THE DRAWINGS

The foregoing summary and the following detailed description will be better understood when read in conjunction with the drawings, in which.

DETAILED DESCRIPTION OF THE PREFERRED EMBODIMENTS

Figure 1:
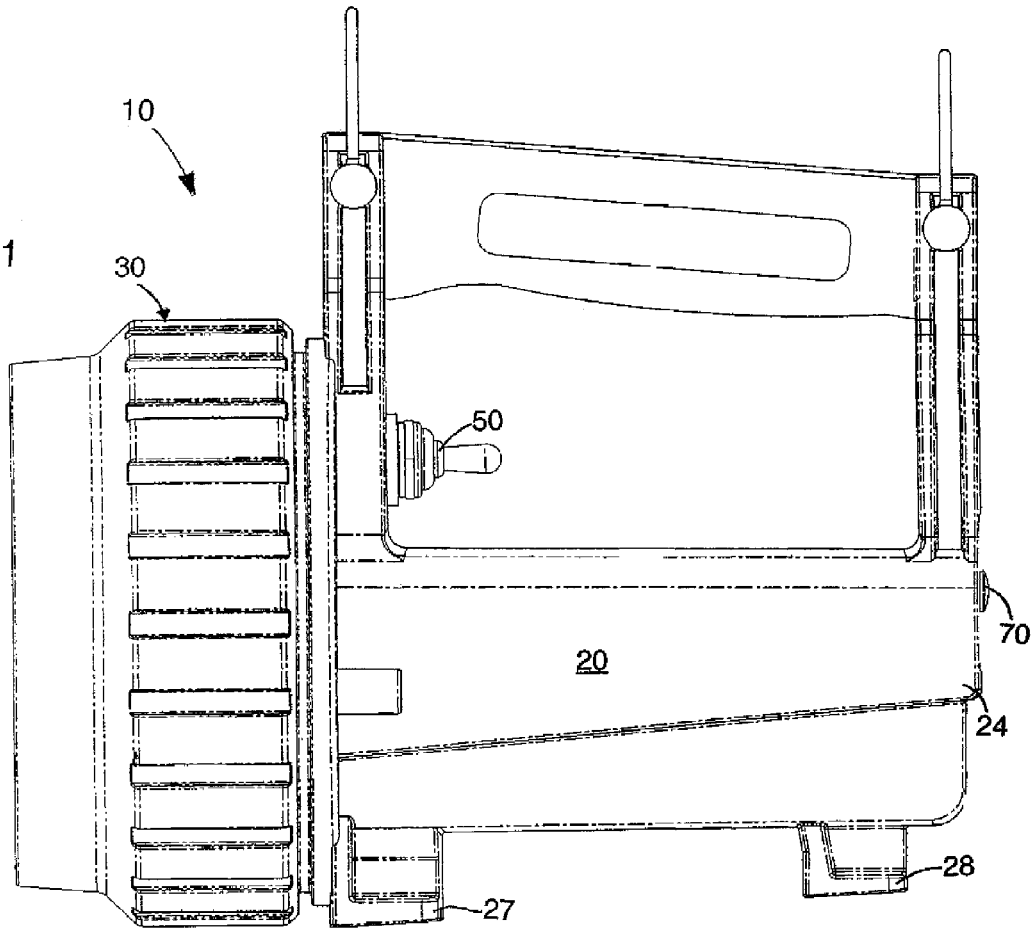
FIG. 1 is a side elevational view of a flashlight.
Figure 3:
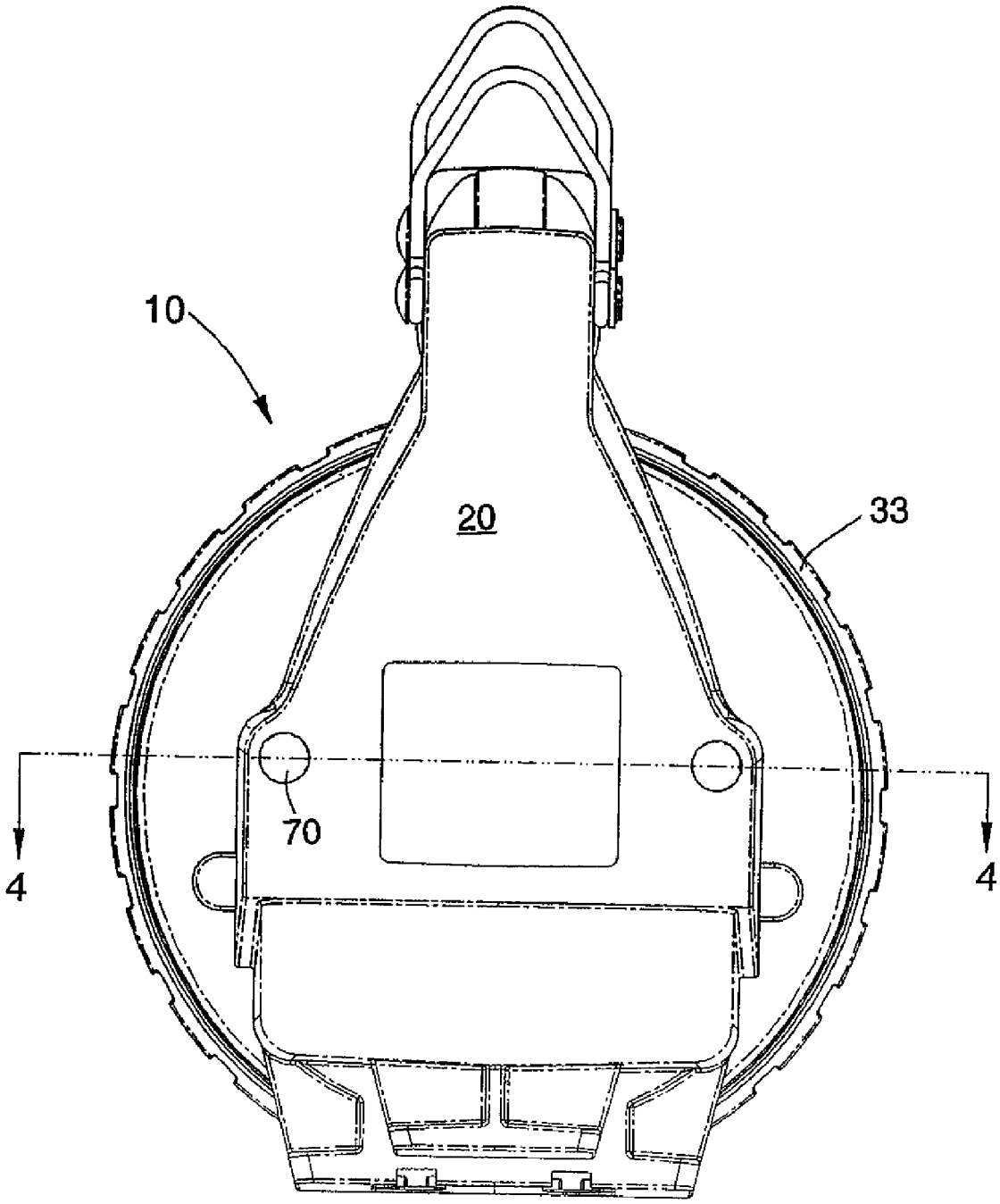
FIG. 3 is a rear elevational view of the flashlight illustrated in FIG. 1.
Figure 4:
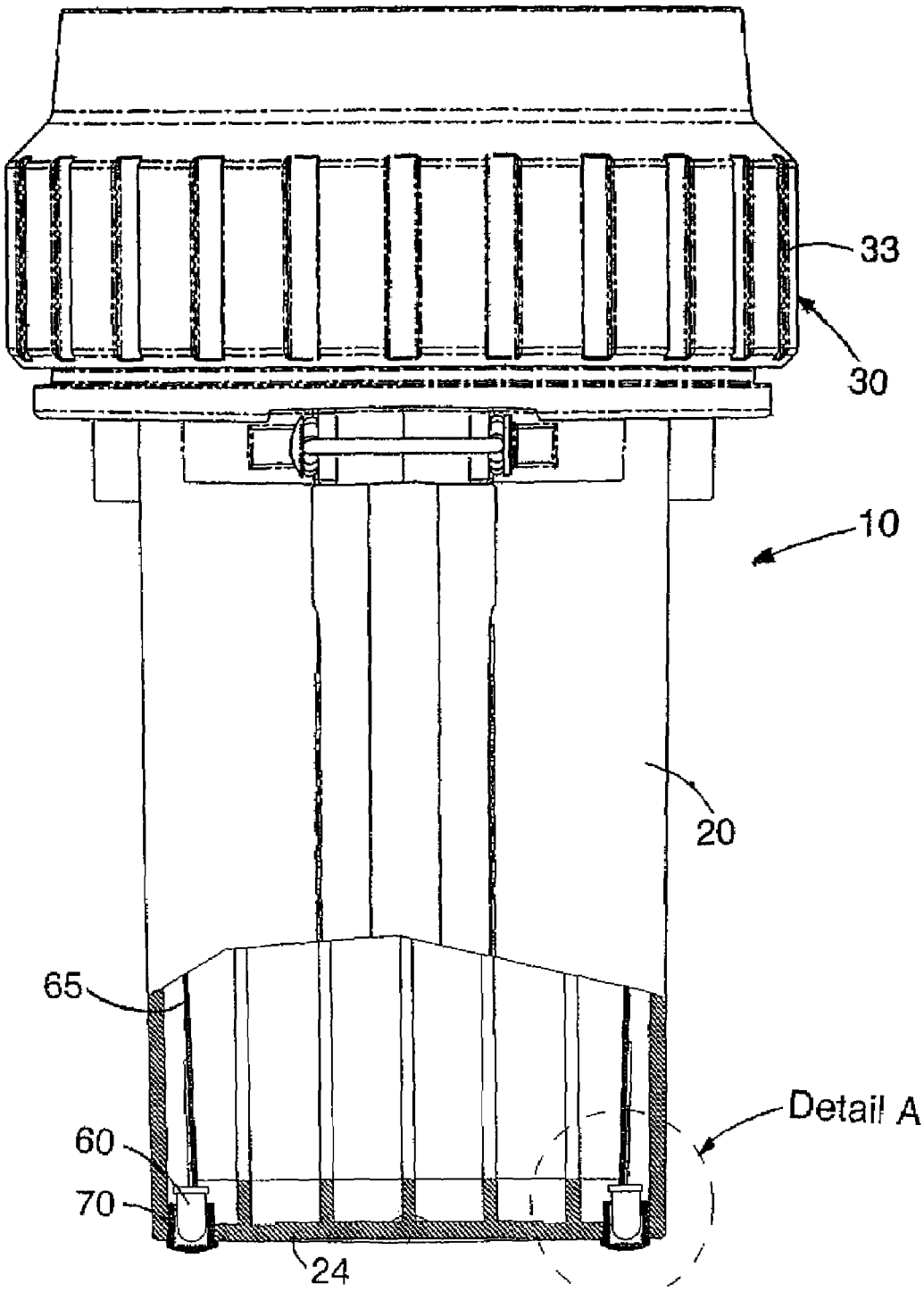
FIG. 4 is a plan view, partially in section of the flashlight illustrated in FIG. 3, taken along the line 4-4.

Referring now to the drawings in general and to FIGS. 1 and 3 specifically, a flashlight is designated generally 10. The flashlight 10 includes a lamp assembly 30 providing a forwardly directed light source, and one or more back lights 60 providing a rearwardly directed light source. The lamp assembly 30 includes a high-powered light to provide general illumination, whereas preferably the back light provides low power light so that the person using the flashlight can be readily identified from behind when using the flashlight.

Figures 2, 2A:
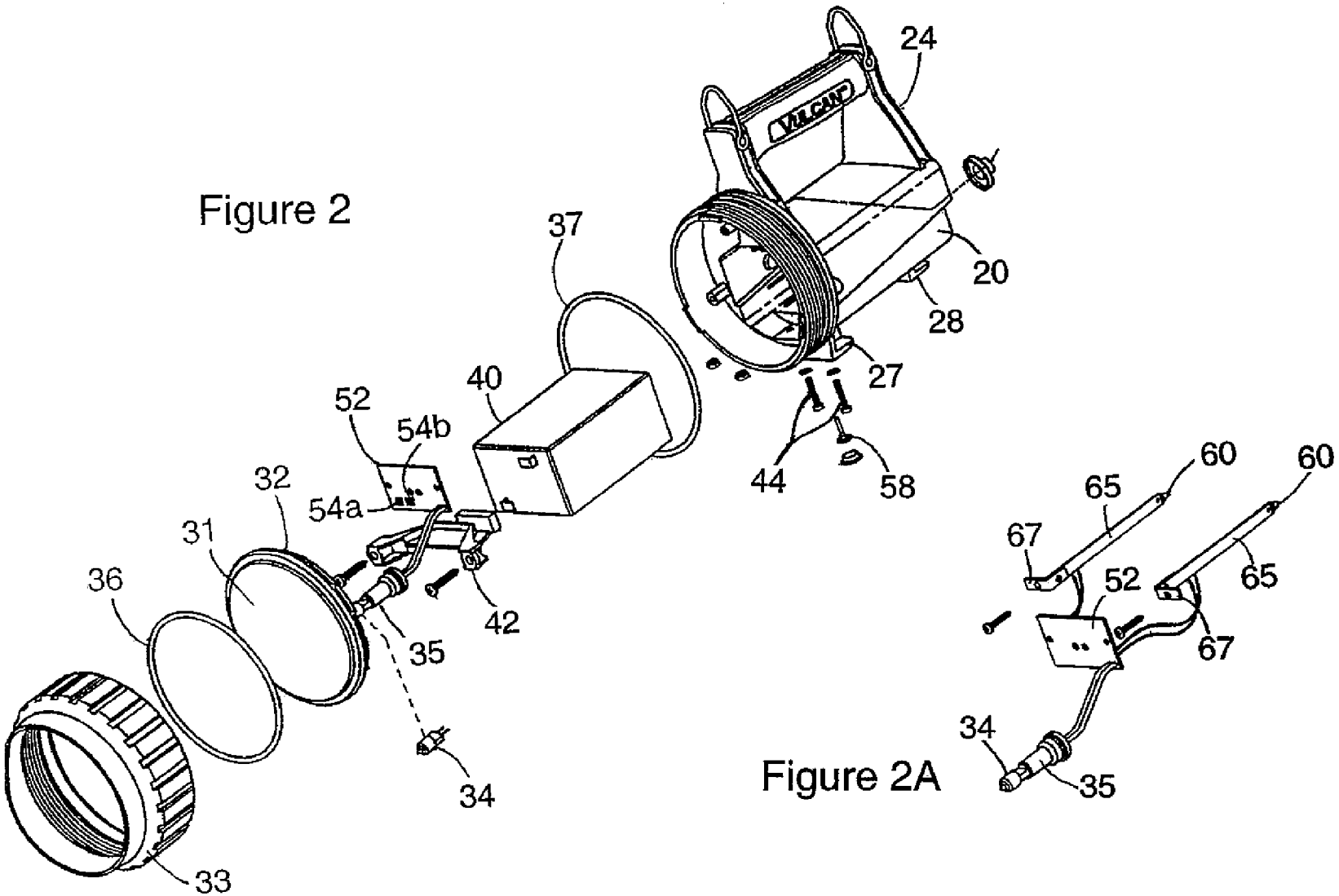
FIG. 2 is an exploded perspective view of the flashlight illustrated in FIG. 1.
FIG. 2A is a perspective view of a portion of the flashlight illustrated in FIG. 1.

Referring now to FIG. 2, an exploded view illustrates most of the elements of the flashlight 10. The flashlight includes a hollow housing 20 having a generally open forward end and a generally closed rearward end. Although the housing 20 may be formed from a variety of material, including various metals and/or plastics, preferably, the housing is formed of high impact ABS.

The forward end of the housing 20 has an externally threaded portion that cooperates with the lamp assembly 30 to attach the lamp assembly to the housing. The lamp assembly 30 preferably includes a lens ring 33, a reflector 32, a lens 31 and a light bulb 34. In the present instance, preferably the lens 31 and the reflector 32 are fixedly connected to one another to form a lens/reflector assembly. However, a separate lens and reflector can also be utilized with the flashlight if desired.

The reflector includes a central aperture for receiving the light bulb 34. More specifically, preferably the light bulb 34 is mounted into a socket 35 and the socket extends into the central aperture of the reflector. In this way, the light bulb 34 projects inwardly into the reflector 32. Preferably, the light socket 35 comprises external threads and the opening in the reflector includes a threaded stem so that the light socket is threadedly connected to the reflector. The light bulb 34 is preferably a high intensity bulb, such as a bulb capable of providing up to 65,000 candlepower. For instance, the light bulb may be an 8 watt halogen bulb or a 6 watt xenon dual filament bulb. Alternatively, the light bulb may be a high intensity, ultra-bright LED.

The lens ring 33 is internally threaded to cooperate with the threaded portion on the front end of the housing 20. The light bulb 34 is connected to the light socket 35, which in turn is inserted into the opening in the reflector. The lens ring 33 is then placed over the lens/reflector and threaded onto the housing so that the reflector/lens is sandwiched between the lens ring and the housing. In addition, to provide a fluid-tight seal between the housing and the lamp assembly 30, preferably a pair of seals 36, 37, such as o-rings, are provided.

The housing includes a compartment configured to receive the battery 40. The battery may be a plurality of separate batteries or a single battery. In addition, the battery 40 may be rechargeable or non-rechargeable. In the present instance, preferably the battery is a 6-volt lead acid rechargeable battery. In addition, preferably a battery clamp 42 holds the battery in place in the housing. Preferably, the battery clamp 42 is similar to a safety bar that confronts the battery. The battery clamp 42 has a central portion formed to cooperate with the top surface of the battery 40, and the ends of the battery clamp have holes for securing the battery clamp. A pair of screws pass through the holes in the ends of the battery clamp and then into internally threaded recesses to screw the battery clamp to the housing.

If the battery is rechargeable, preferably the flashlight 10 includes a pair of charging terminals 44 that cooperate with a battery charger to recharge the battery while the battery remains in the housing. Preferably, the housing 20 comprises a front and back latch 27, 28 projecting from the bottom surface of the housing to cooperate with the charger. The latches operate to connect the flashlight to the charger to secure the flashlight in place on the charger during charging. Preferably, the charging terminals 44 are attached to the forward latch so that the charging terminal on the forward latch engages terminals on the charger to provide an electrical circuit between the charger and the battery.

Since the flashlight is preferably fluid-tight, the flashlight preferably includes a valve allowing escape of gases created by the battery during use. The valve is a one-way valve, allowing gas to pass through the valve and out of the housing, while preventing fluid from entering the housing from outside the housing. In the present instance, the valve projects through a hole in the housing that extends through the front charger latch 27.

Figure 5:
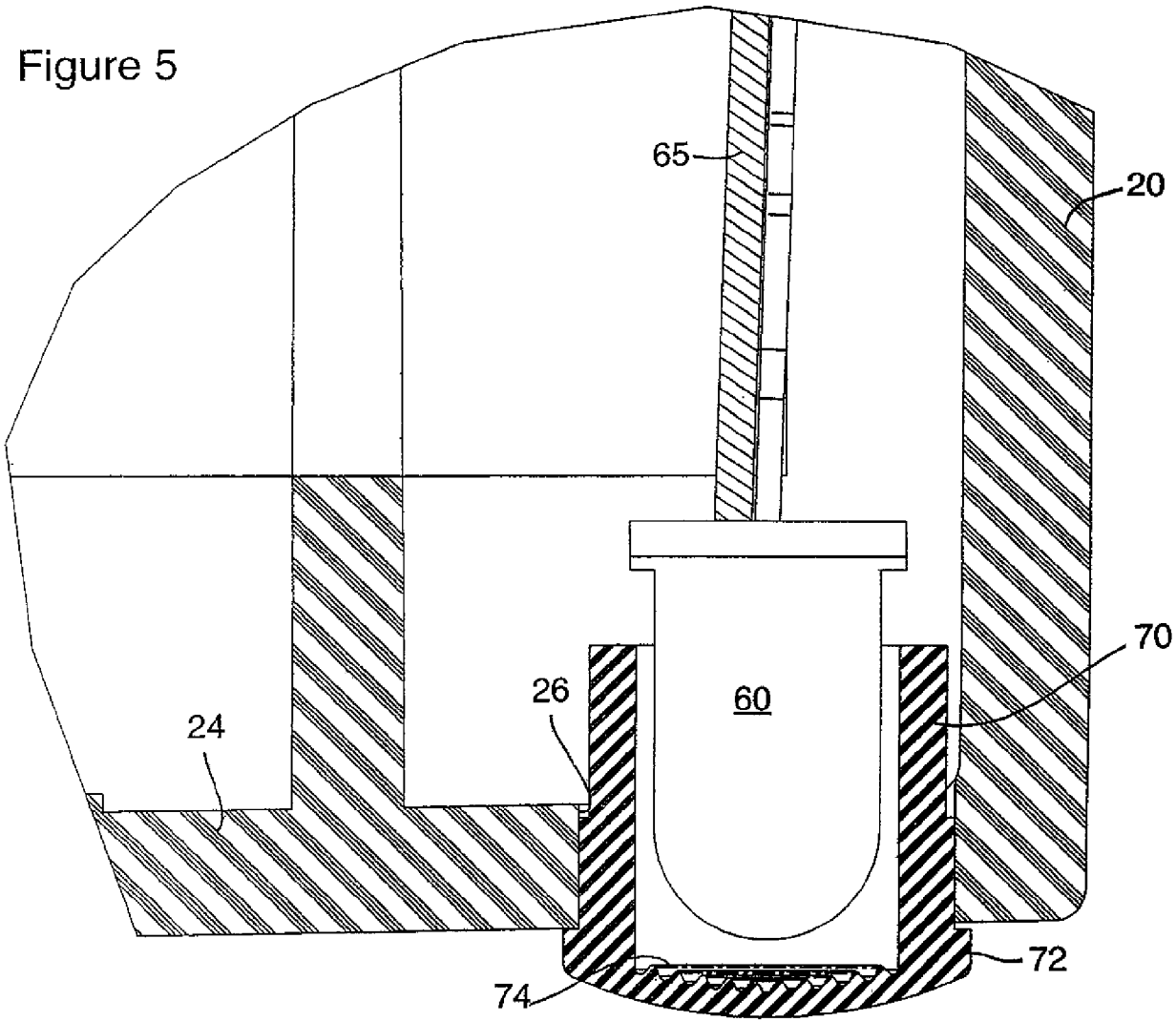
FIG. 5 is an enlarged fragmentary sectional view of the portion of the flashlight in FIG. 4 identified by Detail A.

The rearward end of the housing 20 is generally closed by a back wall 24, which is substantially continuous except for a pair of apertures for the back lights 60. Referring to FIG. 5, the apertures 26 are preferably larger in diameter than the back lights 60 so that the lights can extend into the apertures. Each of the back lights 60 is covered by a cover 70 cover, which encloses each of the back lights 60.

As shown in FIG. 5, each cover 70 is a cup-shaped element. The rearward end of the cover 70 flares outwardly forming an enlarged head 72 having a diameter that is greater than the diameter of the aperture 26. The body portion of the cover 70 is generally cylindrical having an outer diameter that is configured to cooperate with the aperture.

The enlarged head 72 of the cover 70 forms a lens for the back light 60. Accordingly, the head of the cover is transparent or translucent. Depending on the type of light element used for the back light 60, it may be desirable to either focus the light or diffuse the light. However, in typical applications the back light is not primarily provided for illumination so it generally is not desirable to focus the light. Instead, in a typical application the light is used as a signal or locator, so it is desirable to diffuse the light. Accordingly, the cover 70 comprises a diffusion surface 74 for diffusing the light provided by the back lights 60. In applications in which it is desirable to focus the light provided by the back lights 60, a reflector may be provided to focus the rearwardly directed light.

The covers 70 are connected to the housing 20 to seal the apertures 26. In addition, preferably the covers are substantially permanently attached to the housing. Accordingly, the covers 70 may be inserted into the apertures 26 and bonded to the housing. Alternatively, the body portion of the cover may be slightly larger than the apertures to provide an interference fit between the cover and the aperture. In either way, since the head of the cover is preferably larger than the aperture, the head operates as a stop limiting the distance that the cover can be inserted into the aperture. Accordingly, the cover is inserted into the aperture 26 so that the enlarged head abuts the back wall so that the cover is generally flush with the back wall of the housing. Specifically, preferably the cover projects from the back wall a distance that is less than twice a thickness of the back wall, and more preferably a distance that is less than the thickness of the back wall.

Configured as described above, the back lights provide a rearward facing light source that does not project significantly from the back wall of the housing 20. In other words, the back light is substantially enclosed within the housing and the covers are substantially flush with the back wall.

As shown in FIG. 5, the back light 60 is preferably a two pin light element and the pins project into the housing 20. More specifically, preferably the back lights 60 are ultra-bright blue LEDs having two pins. The pins are fixedly connected to conductors 65 that extend between the battery and the back lights 60, as discussed further below.

Referring now to FIG. 1, the operation of the primary lamp 30 and the back lights 60 is controlled by a switch 50. The switch may be configured to have two or more switching positions. However, in the present instance the switch is a toggle switch having three positions, a central or off position, a left position and a right position.

Preferably, the switch 50 cooperates with a switch PCB 52 that controls the operation of the primary lamp and the back lights in conjunction with the switch. The switch PCB is interconnected with the battery 40, the primary lamp element 34, the back lights 60 and the switch 50. In the primary configuration of the switch PCB, the switch controls the flashlight as follows. When the switch is toggled into the left position, continuous power is provided to both the primary lamp 30 and the back lights 60 to provide continuous illumination by the light elements, referred to as a steady mode. When the switch is toggled to the right intermittent power is provided to both the primary lamp 30 and the back lights 60 so that the lights flash, referred to as flashing mode.

Preferably, the flashlight 10 allows the lighting modes to vary from the primary configuration described above. Specifically, preferably the switch PCB 52 comprises a plurality of contacts that are selectively interconnected by a plurality of removable conductive elements, such as jumpers 54*a*, 54*b*, as shown in FIG. 2. By removing one or both of the jumpers, the lighting modes are altered. Specifically, if the first jumper 54*a* is removed, the left switch position turns the primary lamp 30 on in steady mode, but does not turn on the back lights. The right switch position turns on both lights in flashing mode. If the second jumper is removed, the left switch position turns both lights on in steady mode. The right switch position turns on only the back lights in flashing mode. If both jumpers are removed the left position turns on just the primary lamp in steady mode. The rights switch position turns on just the back lights in flashing mode.

The electrical path between the switch PCB 52 and the primary lamp 30 is provided by a conductive cable that is connected to the light socket at one end and to the switch PCB at the other end. The back lights 60 may be similarly connected to the switch PCB. However, preferably, elongated back light PCBs 65 extend between the back lights and the switch PCB. Referring to FIG. 2A, the pins of each of the back lights 60 are soldered directly to one end of a back light PCB 65. A pair of conductive cables are connected to the second end of the PCB connector and also to the switch PCB 52 to complete the electrical path between the back lights and the switch PCB.

The back light PCBs 65 are preferably rigidly connected to the housing 20. Specifically, each of the back light PCBs have a mounting tab 67 fixedly attached to the second end, so that the mounting tab is separated from the electrical path. A fastener, such as a screw, attaches the mounting tab 67 to the housing. Accordingly, the back light PCBs 65 extend within the housing and are preferably spaced apart from the interior wall of the housing.

Figure 6:
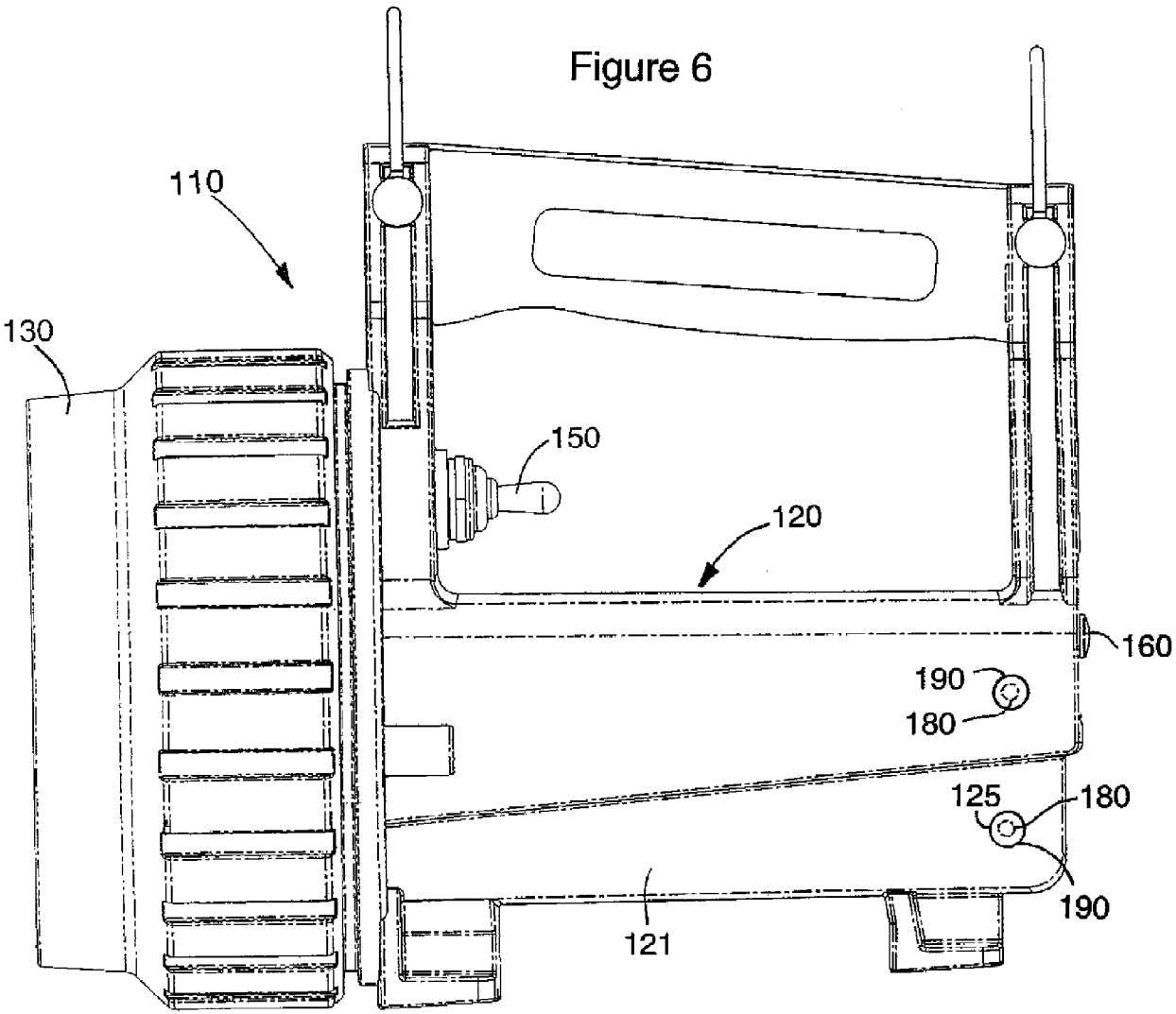
FIG. 6 is a side elevational view of an alternative embodiment of a flashlight.

Referring now to FIG. 6 an alternate embodiment 110 is illustrated with an additional side light option. Elements in the alternative embodiment that are similar to elements in the first embodiment are identified with the same reference numbers with the addition of 100.

The flashlight 110 has a housing that has a front side 121 having apertures 125 for receiving LEDs 180. Preferably, the apertures 125 are configured similarly to the apertures 26 described previously in the first embodiment. In addition, preferably the LEDs 180 are enclosed within the housing 120 by covers 190 that are configured similarly to the covers 70 described above in the first embodiment. In this way, the side lights 180 are enclosed within the housing so that the side lights are substantially flush with the side 121 of the housing. In other words, at least a majority of the length, and preferably substantially the entire length, of the side LEDs 180 are disposed within the apertures 125 and the interior of the housing.

The side LEDs 180 may be provided as an alternative to the back light LEDs described in the first embodiment, so that the flashlight 110 has side lights and a primary lamp 130 similar to the lamp above, but no back lights. However, preferably, the flashlight has back lights 160 similar to the back lights 60 described above. In this way, the flashlight includes a forward light 130, back lights 160 projecting light rearwardly and side lights 180 disposed normal to the back lights and providing a light source directly sidewards from the housing. In addition, preferably the flashlight has side lights on the back side of the housing that are configured and arranged similarly to the sidelights described above. By providing the sidelights and the back lights, the flashlight can be readily seen from either the side or the back.

Preferably, the sidelights are controlled by a switch 150 similar to the switch 50 described above. Preferably the side lights are controlled together with the back lights so that when the back lights are switched on the sidelights are also switched on. However, the switching circuit can be configured to operate the side lights independently from the back lights if desired.

Figure 7:
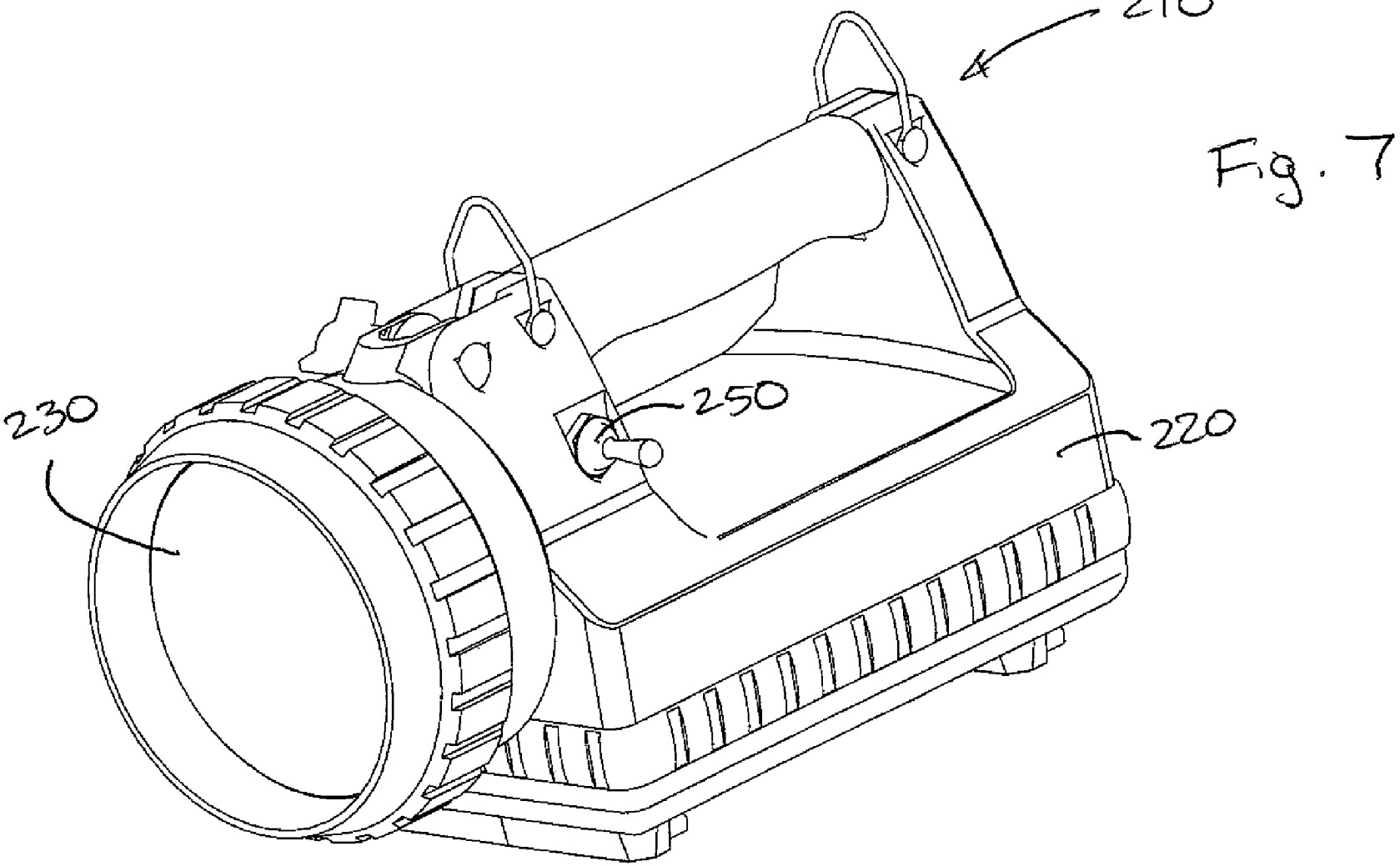
FIG. 7 is a perspective view of a second alternate embodiment of a flashlight.
Figure 8:
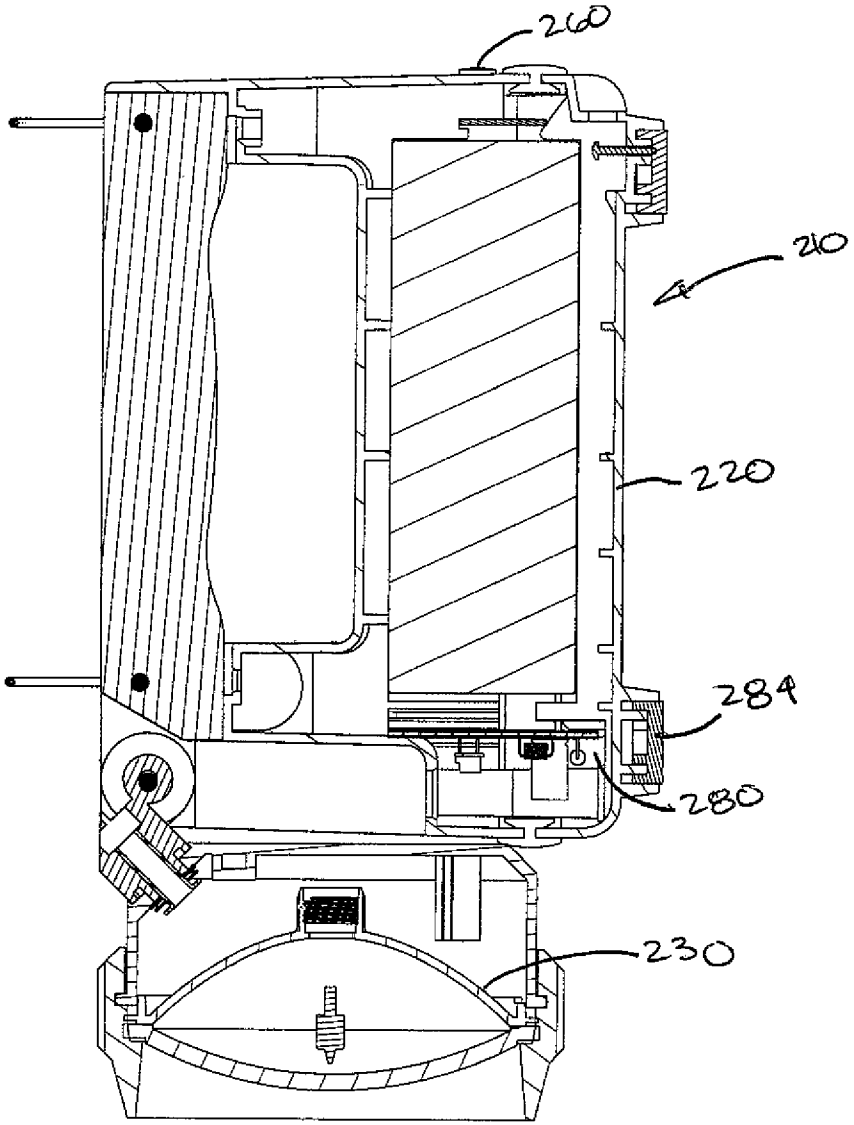
FIG. 8 is a sectional view of the flashlight illustrated in FIG. 7.
Figure 9:
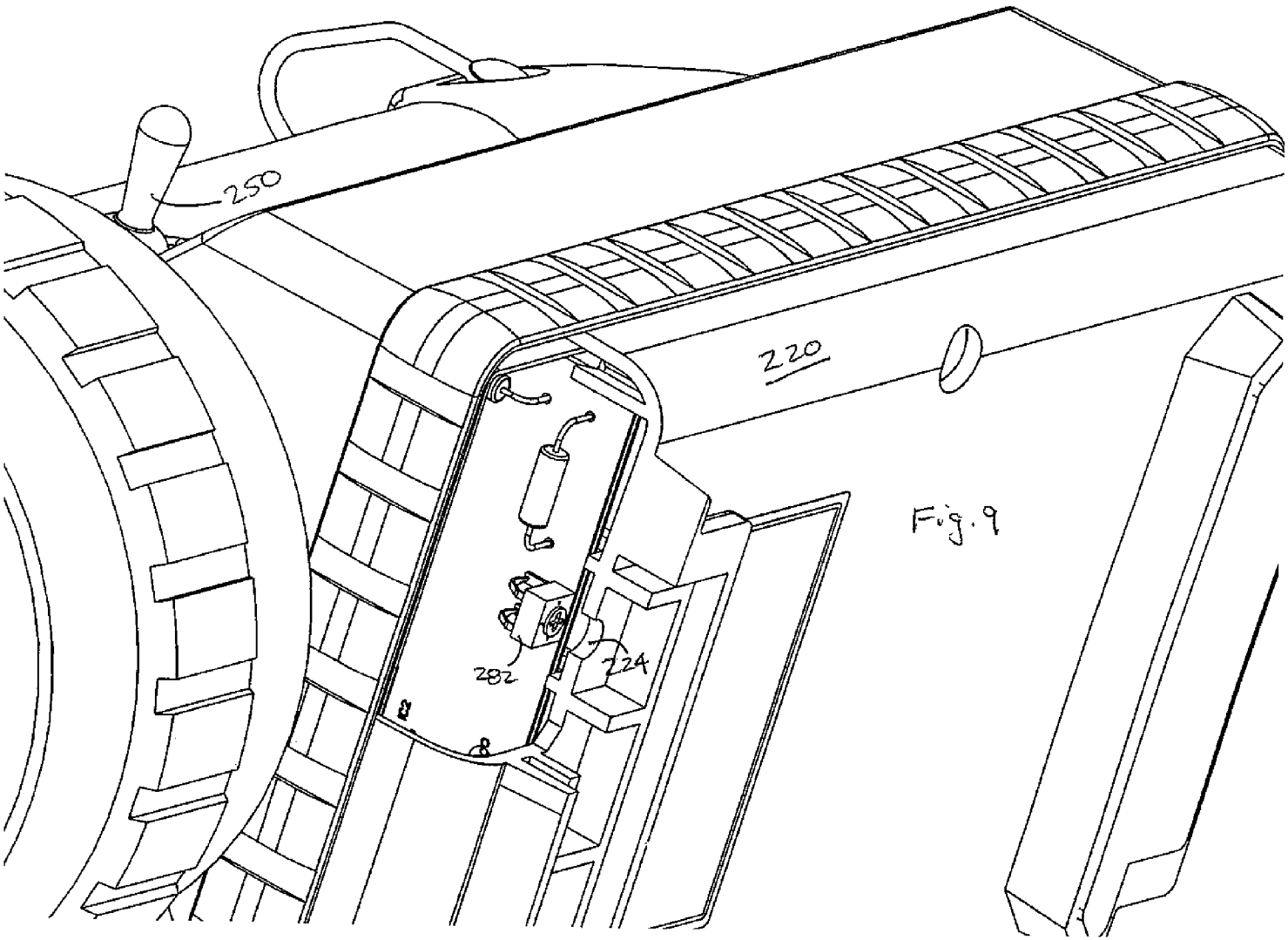
FIG. 9 is an enlarged fragmentary view partially broken away of the flashlight illustrated in FIG. 7.

Referring now to FIGS. 7-9, a third embodiment of a flashlight 210 is illustrated. The third embodiment includes many of the features of the first flashlight 10 described above, however, this third embodiment incorporates a different mechanism for varying the functionality of the switch as described further below.

The third embodiment 210 includes a lamp assembly 230 providing a forwardly directed light source, and one or more back lights 260 providing a rearwardly directed light source. The lamp assembly 230 includes a high-powered light to provide general illumination, whereas preferably the back light provides low power light so that the person using the flashlight can be readily identified from behind when using the flashlight.

Referring now to FIG. 7, the flashlight will be described in greater detail. The flashlight 210 includes a hollow housing 220 having a generally open forward end and a generally closed rearward end. Although the housing 220 may be formed from a variety of material, including various metals and/or plastics, preferably, the housing is formed of high impact ABS.

The lamp assembly 230 is attached to the forward end of the housing 220. The lamp assembly 230 preferably includes a lens ring, a reflector, a lens and a light bulb. In the present instance, preferably the lens and the reflector are fixedly connected to one another to form a lens/reflector assembly. However, a separate lens and reflector can also be utilized with the flashlight if desired. The details and operation of the lamp assembly 230 are substantially similar to the lamp assembly 30 of the embodiment described above in connection with the first embodiment.

The housing 220 includes a compartment configured to receive a battery. As with the previous embodiments, the flashlight may use one or more batteries and the batteries may be rechargeable or non-rechargeable. Since the flashlight is preferably fluid-tight, the flashlight preferably includes a valve allowing escape of gases created by the battery during use as discussed above with the first embodiment.

The rearward end of the housing 220 is generally closed by a back wall that is substantially continuous except for one or more apertures for one or more back lights 260. In the present instance, the back lights 260 are substantially similar to the back lights discussed above in connection with the first embodiment. Specifically, the back light or back lights are configured to provide a rearward facing light source that does not project significantly from the back wall of the housing 220. In other words, the back lights are substantially enclosed within the housing so that they do not substantially protrude from the back wall.

The operation of the primary lamp 230 and the back lights 260 is controlled by a switch 250. The switch may be configured to have two or more switching positions. However, in the present instance the switch is a toggle switch having three positions, a central or off position, an up position and a down position.

Preferably, the switch 250 cooperates with a switch controller 280 that controls the operation of the primary lamp and the back lights in conjunction with the switch. The switch controller 280 is interconnected with the battery, the primary lamp 230, the back lights 260 and the switch 250.

Specifically, the switch controller 280 includes an element for controlling the electrical path between the switch 250, the lamp 230 and the back lights. In the present instance, the switch controller includes a rotary DIP switch mounted on the PCB assembly that is electrically connected with the battery, the front lamp and the back lights. The DIP switch 282 is rotatable between four different positions to vary the light output when the switch 250 is switched on.

For instance, in the primary operational position of the dip switch 282, the flashlight operates as follows. When the switch 250 is toggled into the down position, continuous power is provided to both the primary lamp 230 and the back lights 260 to provide continuous illumination by the light elements, referred to as a steady mode. When the switch is toggled to the up position the primary lamp is in the steady mode and intermittent power is provided to the back lights 260 so that the lights flash, referred to as flashing mode.

If the DIP switch 282 is rotated to a second position, when the switch 250 is toggled to the down position, the primary lamp 230 is switched on in steady mode, but the back lights are not switched on. When the switch 250 is toggled to the up position, the primary lamp 230 is off and the back lights 260 is in the flashing mode.

If the DIP switch 282 is rotated to a third position, the flashlight operates as follows. When the switch 250 is toggled into the down position, the primary lamp is on in the steady mode and the back lights 260 are off. When the switch 250 is toggled into the up position, both the primary lamp 230 and the back lights are switched on in flashing mode.

If the DIP switch 282 is rotated to a fourth position, the flashlight operates as follows. When the switch 250 is toggled into the down position, the primary lamp 230 and the back lights are both switched on in a steady mode. When the switch 250 is toggled into the up position, both the primary lamp 230 and the back lights 260 are switched on in flashing mode.

Referring to FIG. 9, the DIP switch 282 is a rotatable switch that is operable through a hole 224 in the bottom of the housing. Specifically, the DIP switch 282 has a socket or recess configured to cooperate with the tip of a tool, such as a screw driver. In the present instance, the DIP switch is configured to cooperate with a phillips screwdriver. The tip of the screw driver is inserted through the hole 224 in the housing and into the DIP switch. Rotating the screw driver then rotates the DIP switch. In the present instance, the DIP switch is configured so that the four different control positions are angularly spaced apart by approximately 90 degrees.

Since the DIP switch 282 is inside the housing, preferably a seal encloses the opening that provides access to the DIP switch. Specifically, preferably a socket is formed in the housing adjacent the opening to the DIP switch. A seal 284 is configured to sealingly engage the socket to form a fluid tight seal for the hole 224 in the housing. The seal 284 releasably engages the socket so that the seal can be removed to provide access to the DIP switch. For instance, in FIG. 9, the seal is removed so that the hole 224 can be seen.

Although the foregoing describes the preferred embodiments, various alterations can be made without departing from the broad inventive concepts of the invention. For instance, in the third embodiment of the flashlight 210, the switch controller 280 is described as a DIP switch 282 having four different position for varying the light output when the switch 250 is operated. However, the switch controller is not limited to a DIP switch. Further still, the DIP switch could have more or less positions than the four positions described above. For instance, the DIP switch may include 5 different positions with the four positions being the same as those described above and the fifth position may be used to provide an alternating mode for the back lights. Specifically, the back lights may be operable in an alternating mode in which the different back lights alternate on and off (e.g. if the back lights comprise a left light and a right light, in the alternating the mode the right and left lights blink, alternating so that when the left light is on, the right light is off, and vice versa). The switch controller may operate so that in the fifth position, when the switch is in the up position the primary lamp element is switched to a steady on mode and the back lights are off. When the switch is in the down position, the primary lamp element is switched to a steady on mode and the back lights are switched on in an alternating mode.

Numerous advantages of the present invention will be apparent to those skilled in the art from the foregoing specification. It should therefore be understood that this invention is not limited to the particular embodiments described herein, but is intended to include all changes and modifications that are within the scope and spirit of the invention as set forth in the claims.

I claim:

1. A lantern comprising:

a housing having a forward end and a rearward end and a longitudinal axis, wherein the forward end is generally open and the rearward end forms a wall;

a handle connected with the housing and spaced apart from the housing, wherein the handle has a gripping portion that is generally parallel with the longitudinal axis of the housing, and wherein the back wall of the housing has a width that is greater than the width of the handle;

a lamp assembly disposed in the forward end of the housing, having a lamp element configured to provide a beam of light directed forwardly;

a plurality of LEDs wherein each LED is within an aperture formed in the rearward end of the housing to provide a light source directed rearwardly from the housing, wherein the LEDs have a length and substantially the entire length of the LEDs are disposed within the housing, wherein the width of the back wall is substantially greater than the width of the LEDs;

a cover enclosing each aperture in the rearward end of the housing, wherein each cover is substantially flush with the rearward end of the housing;

a switch operable to control the lamp assembly for selectively operating the lamp element, wherein in a first position the lamp element and the LEDs are in a first condition, and in a second position the first LEDs are in a second condition that is different from the first condition; and a battery disposed within the housing.

2. The lantern of claim 1 wherein the at least one of the LEDs project into each aperture in the rearward end of the housing.

3. The lantern of claim 1 wherein the switch is operable to control the operation of the lamp element independently from the LEDs.

4. The lantern of claim 1 wherein when the switch is in the first position the first condition for the lamp element is steady on, and when the switch is in the second position, the first condition for the LED is blinking.

5. The flashlight of claim 1 wherein the first LED is spaced apart from the longitudinal center axis of the housing.

6. The flashlight of claim 1 comprising a diffusion feature for diffusing the light provided by the first LED.

7. A lantern comprising:

a hollow housing having an interior and comprising a forward end, a longitudinal axis and a rearward end having a back wall, wherein an aperture is formed in the back wall;

a handle connected with the housing and spaced apart from the housing, wherein the handle has a gripping portion that is generally parallel with the longitudinal axis of the housing, and wherein the back wall of the housing has a width that is greater than the width of the handle;

a lamp assembly connected with the forward end of the housing, comprising a lamp element to provide a light source projecting forwardly;

an LED providing a light source projecting rearwardly from the housing, wherein the LED is disposed within the aperture so that a majority of the length of the LED is disposed within the aperture and the interior of the housing, and wherein the LED has a width and the width of the back wall of the housing is substantially greater than twice the width of the LED;

a switch for selectively controlling the operation of the lamp assembly and the LED, wherein the switch is operable between a first position in which the lamp assembly and the LED are on in a steady mode and a second position in which at least one of the lamp assembly and the LED are on in a blinking mode; and a battery for providing power for the lamp element and the LED.

8. The lantern of claim 7 comprising an elongated printed circuit board extending along a side of the housing wherein the LED is connected directly to the printed circuit board.

9. The lantern of claim 7 wherein the housing comprises a side wall having a second aperture, and the flashlight comprises a second LED providing a light source projecting sidewardly from the housing, wherein the second LED is disposed within the second aperture.

10. The lantern of claim 7 comprising a cover attached to the back wall of the housing that covers the LED and the aperture.

11. The lantern of claim 7 comprising a switch controller connected with the switch, wherein the switch controller is operable between a first condition and a second condition, wherein changing the switch controller from the first condition to the second condition changes the lighted condition of one of the lamp assembly and the LED when the switch is switched in the first position.

12. The lantern of claim 11 comprising a second LED providing a light source projecting rearwardly from the housing, and wherein the first and second LEDs are operable in an alternating mode in which the two LEDs blink, such that when the first LED is on, the second LED is off, wherein when the switch controller is in the second condition and the switch is switched in the first position, the first and second LEDs operate in the alternating mode.

13. The lantern of claim 7 wherein the battery is disposed within the housing.

14. The lantern of claim 7 wherein the lamp element provide greater candle power than the LED.

15. The flashlight of claim 7 wherein the LED is spaced apart from the longitudinal center axis of the housing.

16. The flashlight of claim 7 comprising a diffusion feature for diffusing the light provided by the LED.

* * * * *